US005311930A

United States Patent [19]

Bruenn

[11] Patent Number: 5,311,930

[45] Date of Patent: May 17, 1994

[54] HEAT RECLAMATION DEVICE

[76] Inventor: Paul R. Bruenn, P.O. Box 917749, Longwood, Fla. 32791

[21] Appl. No.: 978,096

[22] Filed: Nov. 17, 1992

[51] Int. Cl.[5] ..... F28F 27/02; F24C 15/24

[52] U.S. Cl. ..... 165/102; 165/901; 126/301; 126/307 R; 126/100

[58] Field of Search ..... 165/102, 901; 126/300, 126/301, 302, 303, 307 R, 100, 4

[56] References Cited

U.S. PATENT DOCUMENTS

| | | | |
|---|---|---|---|
| 197,321 | 11/1877 | Boswell | 126/302 |
| 374,235 | 12/1887 | Bassett | 126/4 |
| 413,367 | 10/1889 | Hilby | 126/303 |
| 885,470 | 4/1908 | Halley | 126/4 |
| 1,417,404 | 5/1922 | Mustonen | 126/4 |
| 1,438,611 | 12/1922 | Ryerson | 126/307 R |
| 1,759,656 | 5/1930 | Mantle | 165/901 |
| 1,910,199 | 5/1933 | Brady | 261/153 |
| 2,362,940 | 11/1944 | Skerritt | 165/39 |
| 2,553,278 | 5/1951 | Rogant | 126/6 |
| 2,882,023 | 4/1959 | Rizzo | 165/39 |
| 3,011,492 | 12/1961 | Humbert | 126/299 R |
| 3,102,533 | 9/1963 | Jenn et al. | 126/303 |
| 3,190,279 | 6/1965 | Davis | 126/531 |
| 3,409,005 | 11/1968 | Field | 126/300 |
| 3,499,429 | 3/1970 | Perl | 126/21 R |
| 3,536,457 | 10/1970 | Henderson | 422/114 |
| 3,537,442 | 11/1970 | Berger | 126/299 |
| 3,587,555 | 6/1971 | Cerola | 126/1 |
| 3,596,650 | 8/1971 | Cerola | 126/17 |
| 3,612,825 | 10/1971 | Chase | 219/405 |
| 3,624,742 | 11/1971 | Hurko et al. | 126/39 D |
| 3,659,578 | 5/1972 | Davis et al. | 126/21 R |
| 3,685,506 | 8/1972 | Mouat | 126/121 |
| 3,741,194 | 6/1973 | Herron | 126/85 B |
| 3,749,078 | 7/1973 | Dupler | 126/121 |
| 3,783,854 | 1/1974 | Hurko et al. | 126/21 R |
| 3,829,285 | 8/1974 | Beck | 432/223 |
| 3,832,988 | 9/1974 | Doner | 126/21 R |
| 3,834,619 | 9/1974 | Glover | 237/81 |
| 3,888,231 | 6/1975 | Galluzzo et al. | 126/120 |
| 3,889,100 | 6/1975 | Dills | 219/393 |
| 3,952,721 | 4/1976 | Patterson | 126/63 |
| 4,015,579 | 4/1977 | Wirth et al. | 126/63 |
| 4,026,263 | 5/1977 | Boyd | 126/121 |
| 4,034,482 | 7/1977 | Briscoe | 34/35 |

(List continued on next page.)

FOREIGN PATENT DOCUMENTS

| | | | |
|---|---|---|---|
| 209612 | 6/1908 | Fed. Rep. of Germany | 165/102 |
| 353163 | 3/1921 | Fed. Rep. of Germany | 126/4 |
| 121329 | 9/1980 | Japan | 165/901 |
| 1474385 | 4/1989 | U.S.S.R. | 165/901 |

*Primary Examiner*—John Rivell
*Assistant Examiner*—L. R. Leo
*Attorney, Agent, or Firm*—William A. Birdwell & Associates

[57] ABSTRACT

A device for reclaiming waste heat from cooking appliances. The device includes a baffle through which exhaust from the cooking appliance flows, an inlet for receiving exhaust from the cooking appliance, and an outlet for venting exhaust to the atmosphere outside the building or vehicle in which the cooking appliance is located. The baffle extracts heat from the exhaust as the exhaust flows therethrough. The baffle is in thermal communication with a heat sink that directs the extracted heat to the building or vehicle spaces to be heated. The heat reclamation device has a generally thin profile so that the device may be installed above and behind the work surface of the cooking appliance so as to consume a minimal amount of space while not interfering with the normal use of the appliance. The heat reclamation device has means to vent the exhaust directly to the atmosphere, bypassing the baffle.

14 Claims, 4 Drawing Sheets

U.S. PATENT DOCUMENTS 4,042,160 8/1977 Ickes ..... 126/121
4,049,194 9/1977 Tice et al. ..... 237/1 A
4,050,628 9/1977 Konnerth, III ..... 237/55
4,055,297 10/1977 Lee ..... 236/11
4,061,186 12/1977 Ljung ..... 165/59
4,083,398 4/1978 Fallon, Jr. et al. ..... 165/66
4,095,514 6/1978 Roy et al. ..... 98/58
4,111,181 9/1978 Canney ..... 126/77
4,125,854 11/1979 Andrews ..... 431/11
4,127,100 11/1978 Baker ..... 126/110 B
4,136,662 1/1979 Willson ..... 126/61
4,140,101 2/1979 Glover ..... 126/110 B
4,143,638 3/1979 Kamstra et al. ..... 126/121
4,150,658 4/1979 Woods ..... 126/63
4,171,722 10/1979 Huggins ..... 165/95
4,180,052 12/1979 Henderson ..... 126/108
4,201,185 5/1980 Black ..... 126/77
4,204,517 5/1980 Rumsey ..... 126/63
4,206,742 6/1980 Johnson ..... 165/901
4,206,804 6/1980 Scholtes et al. ..... 165/901
4,215,814 8/1980 Ebert ..... 236/1 G
4,251,024 2/1981 Feinberg ..... 236/1 G
4,262,843 4/1981 Omori et al. ..... 236/15 C
4,263,891 4/1981 Mets ..... 126/299 D
4,276,929 7/1981 Howard ..... 165/145
4,320,869 3/1982 Ebert ..... 165/901
4,361,131 11/1982 Homolik ..... 126/123
4,406,396 9/1983 Habegger ..... 236/1 G
4,411,254 10/1983 Field et al. ..... 126/300
4,425,901 1/1984 Callison ..... 126/6
4,446,849 5/1984 McFarland ..... 126/299 R
4,448,348 5/1984 Bidwell ..... 237/55
4,455,994 6/1984 Homolik ..... 165/901
4,457,293 7/1984 Berlik ..... 126/39 N
4,483,316 11/1984 Fritz et al. ..... 126/299
4,493,310 1/1985 McInnes ..... 126/307 R
4,506,651 3/1985 Paradis ..... 126/4
4,527,538 7/1985 Caferro ..... 126/21 R
4,550,772 11/1985 Knoch ..... 165/47
4,562,827 1/1986 Cerola ..... 126/299 R
4,580,621 4/1986 Lovrich et al. ..... 165/47
4,627,415 12/1986 Kamo et al. ..... 126/299 R
4,742,957 5/1988 Mentuch ..... 237/46
4,788,964 12/1988 Dorsey et al. ..... 126/299 R
4,878,479 11/1989 Stuitje ..... 126/84
4,984,558 1/1991 Lok ..... 126/307 R

HEAT RECLAMATION DEVICE

BACKGROUND OF THE INVENTION

This invention relates to heating devices, particularly heat reclamation devices that are adapted to be attached to ovens, ranges or similar cooking appliances so as to reclaim waste heat from the exhaust thereof in order to heat buildings or vehicles in which the cooking appliance is located, while requiring minimal space and being relatively maintenance free.

Ovens, ranges and similar cooking appliances generate waste heat in their exhaust that is ordinarily lost in venting the exhaust to the atmosphere. It is often desirable to reclaim the waste heat from that exhaust in order to heat, for example, the interior spaces of the building or vehicle in which the cooking appliance is located. It is also desirable to reclaim that heat using a device that consumes a minimal amount of space, is lightweight, is relatively maintenance free, is thermally efficient, and includes a simple means by which the extraction of heat may be selectively turned on or off. In addition, it is desirable to reclaim the heat using a device that vents dangerous gases and moisture out of the appliance into the atmosphere, rather than into living spaces, and that provides sufficient draft as to prevent backdraft of the gases and moisture into the cooking appliance.

The above-identified features are particularly desirable when reclaiming heat in small manufactured homes, campers, motor homes, trailers and other structures where interior space generally is limited and cooking appliances frequently use propane, a fuel that produces exhaust containing moisture and dangerous gases.

Heating devices that reclaim waste heat from the exhaust of various heat sources for use in heating living spaces are known, and take a variety of forms, each with significant limitations. One conventional form includes an enclosure seated on and covering the entire cooking surface of a stove. The enclosed air is heated both by the stove's radiant heat and by the waste heat contained in the stove's exhaust. Examples of this form are described in Rogant U.S. Pat. No. 2,553,278 and Hilby U.S. Pat. No. 413,367.

This form of heating device is subject to significant limitations, including that the simultaneous use of the stove for heating and for cooking is precluded because the enclosure must be either seated to heat o removed to cook. This form also tends to consume a large amount of space. Accordingly, this form is not well adapted for use in small manufactured homes, campers, motor homes, trailers and other such structures.

A second conventional form reclaims waste heat from the exhaust of a cooking surface by collecting the exhaust using a hood fixed in position above and away from the cooking surface. This form is particularly adapted for use in restaurants. An example of this form is described in Huggins U.S. Pat. No. 4,171,722 ("Huggins").

This second form of heating device, as shown by Huggins, is also subject to significant limitations. For example, Huggins is complex in design, requiring a hood, conduits, blowers, filters, heat exchanger elements, dampers, and an electric motor. With its complexity, Huggins' heating device tends to be expensive and to require a relatively high amount of maintenance. Moreover, Huggins' heating device consumes a large amount of space, and it is to be installed largely on the exterior of the structure in communication with the cooling surface and the heated space by means of a network of conduits. Accordingly, this form also is not well adapted for use in small manufactured homes, campers, motor homes, trailers and other such structures.

A third conventional form of heating device reclaims waste heat from the flue gases of heating stoves and furnaces. This form generally is used to supplement the heat generated by heating stoves and furnaces, and is available in a large number of variations having various features. In one variation, this form is positioned above and behind the stove and consumes a smaller amount of space than the aforementioned forms, in particular, by having a somewhat flat geometry. An example of this form is described in Johnson U.S. Pat. No. 4,206,742 ("Johnson") wherein flue gases pass though a set of vertical tubes having outside surfaces that transfer heat to air directed thereover by a blower.

This third form of heating device is also subject to significant limitations, including that this form tends to consume more than the desired minimal amount of space. Although Johnson is somewhat flat in geometry, it must be deep enough to accommodate a large number of tubes disposed in spaced, offset rows so as to provide efficient heat exchange. Moreover, use of tubes increases maintenance because the tubes' relatively narrow internal diameter tends to cause depositing that must be removed regularly when the heat source's exhaust contains particulates. Indeed, Johnson provides access to the tubes in order to facilitate that maintenance. While wider diameter tubes may be used to lessen maintenance, such wider tubes tend to increase space consumption by increasing the depth of the apparatus and tend to reduce heat reclamation efficiency. Accordingly, this form also is not well adapted for use in small manufactured homes, campers, motor homes, trailers and other such structures.

Because known conventional heating devices that reclaim heat have inherent shortcomings when used in small manufactured homes, campers, motor homes, trailers and other such structures, a need exists for an improved heating device that reclaims waste heat, particularly for use in such buildings and vehicles.

SUMMARY OF THE INVENTION

The present invention fulfills the need for an improved heating device that reclaims waste heat from ovens, stoves and other similar cooking appliances, overcomes the shortcomings of prior art heating devices and provides certain advantages not heretofore available in such heating devices by providing a compact heat reclamation device that does not interfere with the normal use of the cooking appliance and is relatively maintenance free.

In a preferred embodiment, the heat reclamation device comprises a housing having an inlet into which exhaust from a cooking appliance flows, a baffle through which the exhaust flows, and an outlet venting the exhaust to the atmosphere outside the building or vehicle in which the cooking appliance is located. The baffle extracts heat from the exhaust as the exhaust flows therethrough. The baffle is in communication with a heat sink that directs the extracted heat to the interior spaces of the building or vehicle. The heat sink has radiation fins extending away from the baffle beyond the housing so as to efficiently direct the extracted heat to the interior spaces. The heat reclamation device combines the housing, inlet, baffle, outlet and heat sink in a geometry having a generally thin profile so that the device may be installed above and behind the work surface of a cooking appliance, consuming a minimal amount of space while not interfering with the normal use of the appliance.

The heat reclamation device preferably includes a means to force air flow over the radiation fins for increasing reclamation efficiency and a means to reclaim heat selectively. Ordinarily, a fan is used for forcing air flow and a user-controlled gate is used for directing exhaust either into the baffle for heat reclamation or to a bypass conduit away from the baffle to prevent such extraction.

Accordingly, it is a principal object of the present invention to provide a novel and improved heat reclamation device.

It is another object of the present invention to provide a heat reclamation device that reclaims waste heat from ovens, stoves and other similar cooking appliances while not interfering with the normal use of the cooking appliance.

It is a further object of the present invention to provide a heat reclamation device that requires minimal space.

It is another object of the present invention to provide a heat reclamation device that is thermally efficient.

It is yet a further object of the present invention to provide a heat reclamation device that is particularly adapted for use in small manufactured homes, campers, motor homes, trailers and other such structures.

It is yet another object of the present invention to provide a heat reclamation device that is simple in design so as to be easy to manufacture and use, relatively maintenance free, economical to manufacture, inexpensive to purchase and easy to install.

The foregoing and other objects, features and advantages of the invention will be more readily understood upon consideration of the following detailed description of the invention, taken in conjunction with the accompanying drawings.

DETAILED DESCRIPTION OF THE INVENTION

Figure 1:
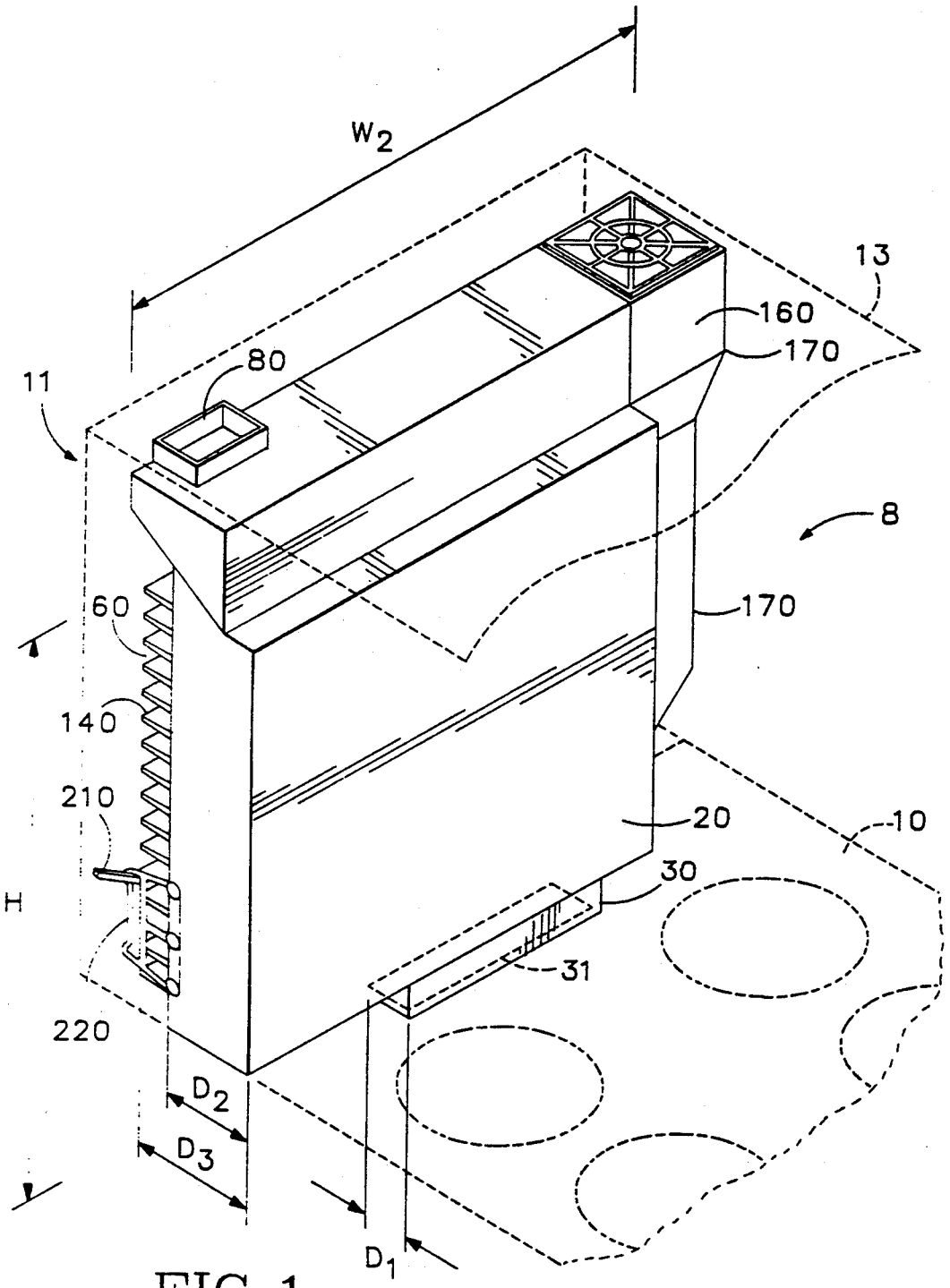
FIG. 1 is a front perspective view of a preferred embodiment of a heat reclamation device according to the present invention, attached to a cooking appliance and installed in a work area.

A preferred embodiment of a heat reclamation device 8 according to the present invention is shown in FIG. 1, attached above and at the rear of an exemplary range 10 and installed in a work area 11 having an upper boundary 13. Although the embodiment shown is attached to the range 10, it is to be recognized that the heat reclamation device 8 may be used with cooking appliances of other types, sizes and shapes without departing from the principles of the invention.

Figure 2:
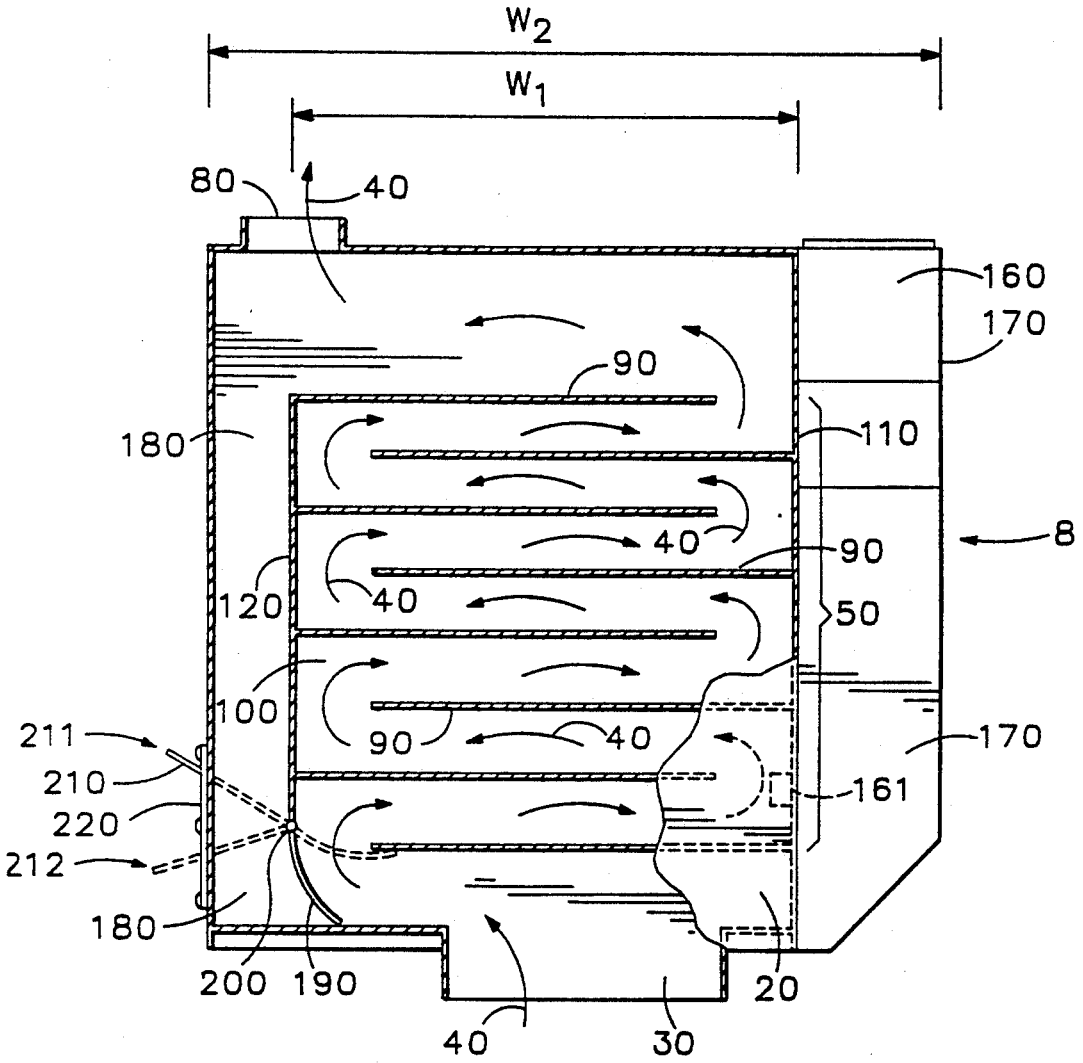
FIG. 2 is a front view of the heat reclamation device of FIG. 1 with the housing partially cut away.
Figure 3:
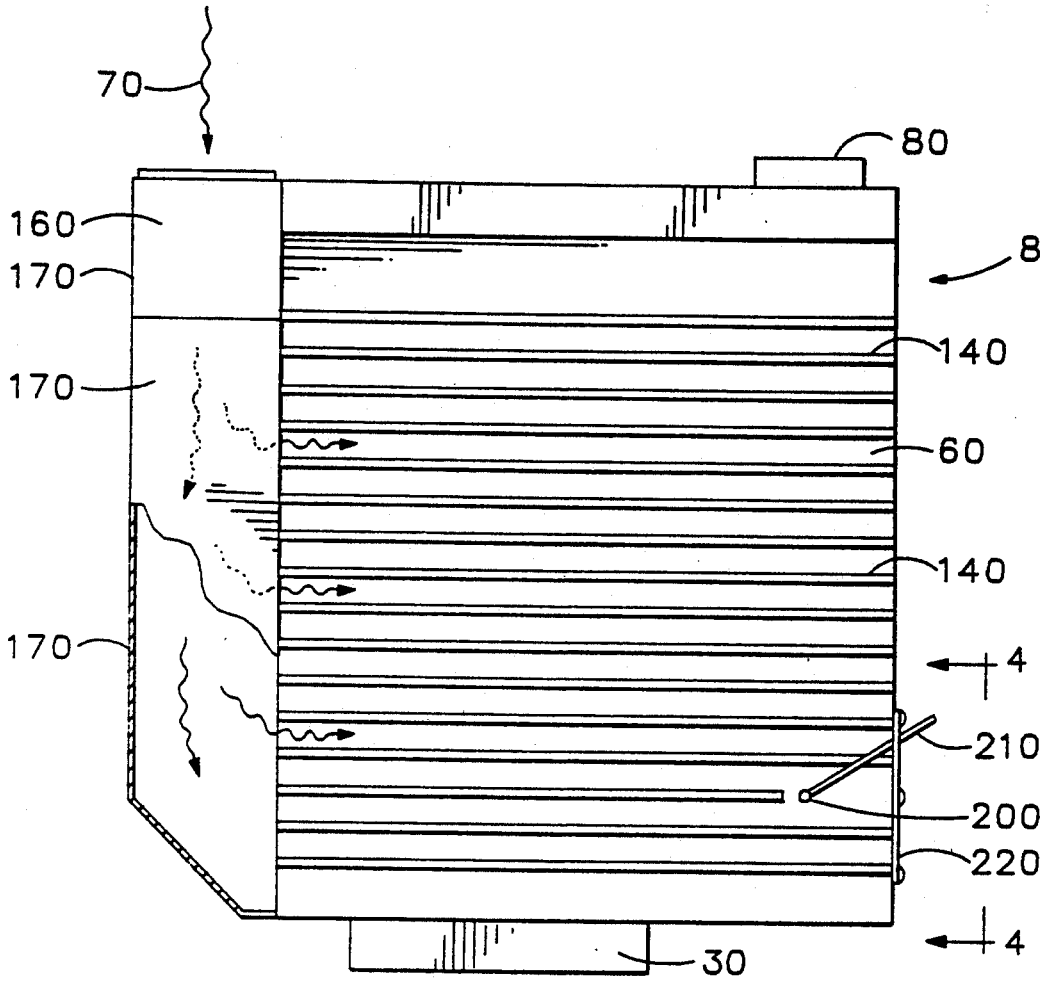
FIG. 3 is a back view of the heat reclamation device of FIG. 1 with a fan housing incorporated therein partially cut away.

Referring to FIGS. 2 and 3, as well as FIG. 1, the heat reclamation device 8 comprises a housing 20, an inlet 30 into which flows exhaust 40 from an exhaust outlet of the cooking appliance 10, a baffle 50 through which the exhaust 40 flows, heat sink 60 in communication with the baffle 50 to transfer the heat extracted by the baffle 50 to ambient air 70, and an outlet 80 venting the cooled exhaust 40 directly, or through supplemental ducting (not shown), to the atmosphere outside the building or vehicle in which the cooking appliance 10 is located. Although the inlet 30 shown in FIG. 1 is positioned inside the cooking appliance 10, it is to be recognized that the inlet 30 may be positioned in various ways without departing from the principles of the invention, provided that it is in communication with the exhaust outlet commonly provided in cooking appliances, for example, exhaust outlet 31 of range 10.

Referring to FIG. 2, the baffle 50 is formed by a plurality of baffle elements 90, a back wall 100, a side wall 110, a bypass wall 120 and the housing 20. The baffle elements 90 as shown are rectangular blades extending away from the back wall 100, disposed with the longitudinal axis thereof along the width of the heat reclamation device 8 and positioned in substantially parallel planes at substantially uniform intervals along the height of the heat reclamation device 8. From bottom to top of the device, the baffle elements 90 alternate between contact with the side wall 110 and with the bypass wall 120 so as to form, together with the back wall 100, a circuitous channel that has a generally folded shape. The circuitous channel is covered by the housing 20 to form the baffle 50. In use, the exhaust 40 flows through the baffle 50, whereupon the exhaust 40 loses heat contained therein to the baffle 50.

Although the baffle shown in FIG. 1 is a circuitous channel having horizontally disposed folds, it is to be recognized that the baffle may have folds disposed in other directions, provided that the baffle efficiently extracts heat from the exhaust 40. For example, referring to FIG. 5, an alternative embodiment of the heat reclamation device 8 has a baffle 51 that forms a channel having vertically disposed folds. The baffle 51 is formed by plurality of baffle elements 96, the back wall 100, the side wall 110, a top wall 111, a bottom wall 112, the by-pass wall 120 and the housing 20. The baffle elements 96, as shown, are rectangular blades extending away from the back wall 100, disposed with the longitudinal axis thereof along the height of the heat reclamation device 8 and positioned substantially in parallel planes at substantially uniform intervals along the width of the heat reclamation device 8. From the side wall 110 to the bypass wall 120, the baffle elements 96 alternate between contact with the top wall 111 and the bottom wall 112 so as to form, together with the back wall 100, the side wall 110 and the bypass wall 120, a circuitous channel that has vertically disposed folds. The circuitous channel is covered by the housing 20 to form the baffle 51. In use, the exhaust 40 flows through the baffle 51, whereupon the exhaust 40 looses heat contained therein to the baffle 51.

Figure 5:
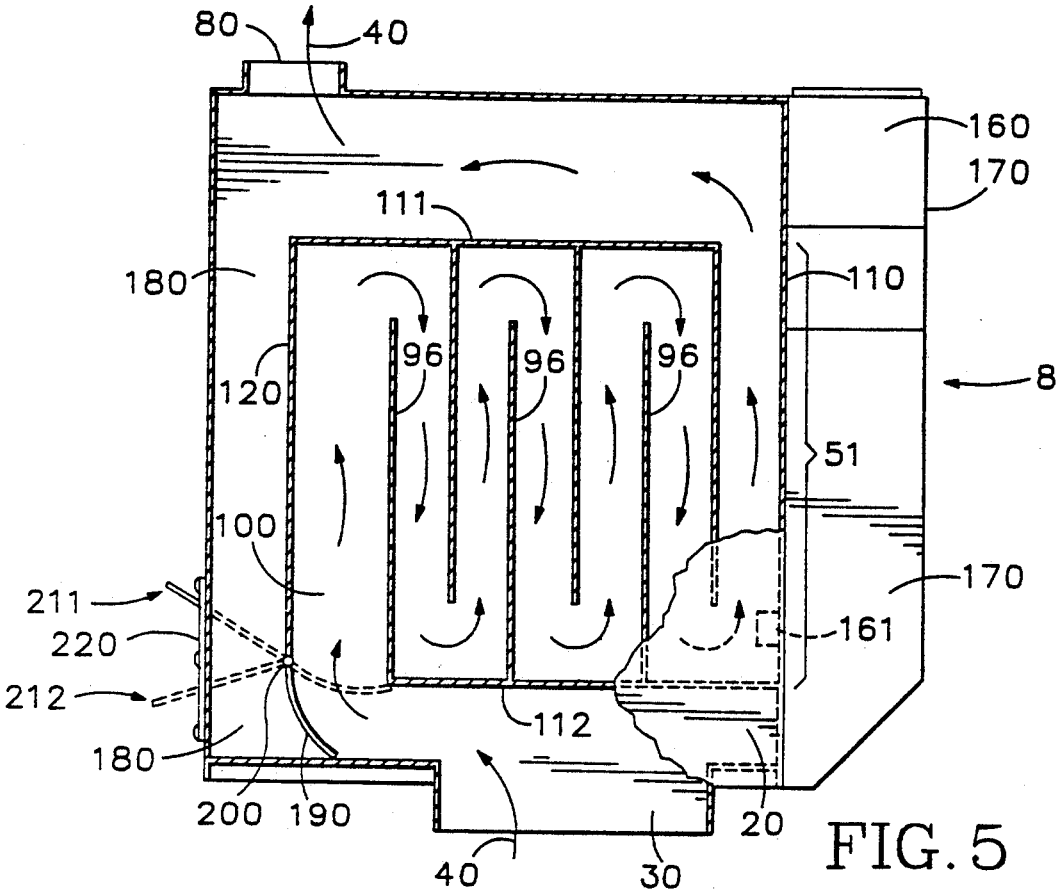
FIG. 5 is a front view of an alternative embodiment of a heat reclamation device according to the present invention, showing a first alternative form of baffle with the housing partially cut away.

Although the baffles shown in FIGS. 1 and 5 are circuitous channels having generally folded shapes, it is to be recognized that the baffle may have other shapes, provided that the baffle efficiently extracts heat from the exhaust 40. For example, referring to FIG. 6, a second alternative embodiment of the heat reclamation device 8 has a baffle 52 that forms a channel of a generally spiral shape having a center baffle 128. The center baffle 128 is in communication with the outlet 80 by means of a venting conduit 130 so as to vent the cooled exhaust 40 to the atmosphere. The venting conduit 130 preferably extends horizontally from the center baffle 128 through the heat sink 60, then extends vertically upward to the outlet 80. The venting conduit 130, as shown if FIG. 6, preferably has a first side 132 and a second side 134 that flare from the center baffle 128 respectively toward the side wall 110 and an outside wall 136 of the device. It is to be recognized that the venting conduit 130 can be of other shapes without departing from the principles of the invention.

Figure 6:
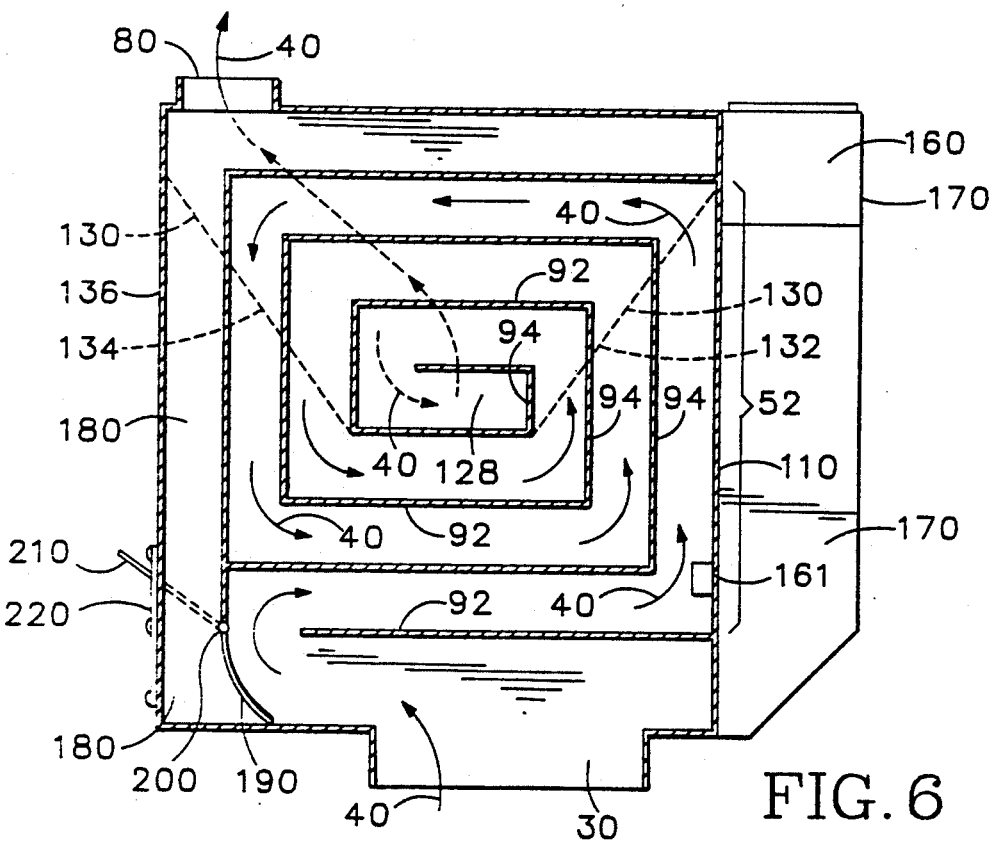
FIG. 6 is a front view of an alternative embodiment of a heat reclamation device according to the present invention, showing a second alternative form of baffle with the housing partially cut away.

The baffle 52 of the second alternative embodiment is formed by a plurality of horizontal baffle elements 92, a plurality of vertical baffle elements 94, the back wall 100, the side wall 110, the bypass wall 120 and the housing 20. The horizontal baffle elements 92 as shown are rectangular blades extending away from the back wall 100, disposed with the longitudinal axis thereof along the width of the heat reclamation device 8 and positioned in substantially parallel planes spaced at substantially uniform intervals along the height of the heat reclamation device 8. The vertical baffle elements 94 as shown are rectangular blades extending away from the back wall 100, disposed with the longitudinal axis thereof along the height of the heat reclamation device 8 and positioned in substantially parallel planes spaced at substantially uniform intervals along the width of the heat reclamation device. As shown in FIG. 6, the horizontal baffle elements 92 and vertical baffle elements 94 are of various corresponding, predetermined lengths so that the horizontal baffle elements 92 alternate with the vertical baffle elements 94 to form, together with the back wall 100, a spiral-shaped circuitous channel that is covered by the housing 20 to form the baffle 52.

Figure 4:
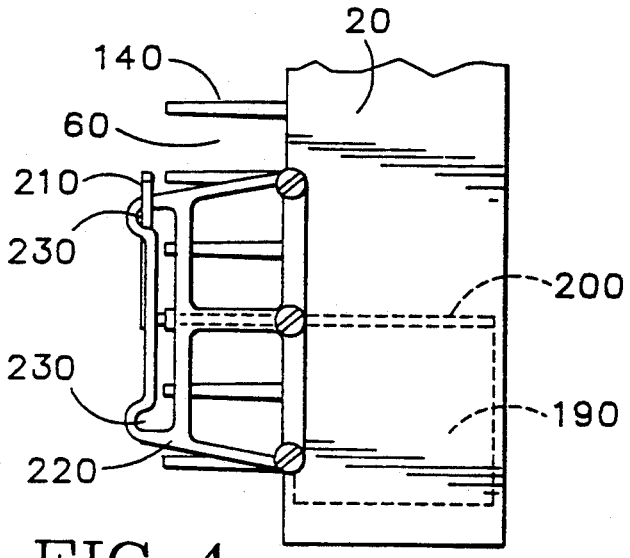
FIG. 4 is a side view of the heat reclamation device of FIG. 3 taken along line 4—4 thereof and showing a gate thereof by hidden lines.

Referring to FIGS. 1, 3 and 4 in particular, the heat sink 60 is in thermal communication with the baffle 50 so that, in use, the heat extracted by the baffle 50 is transferred to the heat sink 60 and therefrom is transferred by the heat sink 60 to ambient air 70. To transfer heat efficiently, the heat sink 60 preferably has a plurality of radiation fins 140 extending beyond the housing 20. Although the radiation fins shown are substantially rectangular blades disposed with the longitudinal axis thereof across the width of the heat reclamation device and positioned in substantially parallel planes spaced at substantially uniform intervals along the height of the device, it is to be recognized that the radiation fins may be of other shapes, dispositions and positions without departing from the principles of the invention, provided that they efficiently transfer the extracted heat to the ambient air 70.

The radiation fins 140 of the heat sink 60 and the baffle elements 90 and baffle wall 100 of the baffle 50 preferably are formed as one piece. In that construction, the baffle elements 90 and the radiation fins 140 are disposed on and extend away from opposite faces of the baffle wall 100. The baffle wall 100 preferably is substantially planar and has a thin cross-section so as to efficiently transfer the extracted heat from the baffle 50 to the radiation fins 140 and to maintain a thin overall cross-section for the heat reclamation device. Such one piece construction may be by joining separate pieces without departing from the principles of the invention, provided the heat sink 60 and baffle 50 are in thermal communication for the efficient transfer of extracted heat therebetween.

Preferably, the exterior surface area of the heat sink 60 substantially equals the interior surface area of the baffle 50, 51 or 52. In addition, the interior surface of the baffle 50, 51 or 52 preferably has a non-smooth finish so as to increase heat extraction.

The heat sink 60 and the baffle 50, 51 or 52 preferably are formed from a material having a high capacity to extract, conduct and radiate heat in order to maximize the efficiency of the device in reclaiming heat. For example, when formed as one piece, the radiation fins 140, the back wall 100, and the baffle elements 90 of baffle 50 preferably are cast from aluminum. However, other materials having similar thermal characteristics may be employed without departing from the principles of the invention.

The housing 20 preferably is constructed from a material having a high capacity to extract, conduct and radiate heat so that it can extract heat from the exhaust 40 and either transfer that heat to the heat sink 60 or radiate that heat directly to the living space. The housing 20 preferably is constructed from aluminum, although other materials may be used without departing from the principles of the invention.

It is to be recognized that, under some circumstances, it may be necessary or desirable to keep the exterior surfaces of the housing 20 cool. In such circumstances, the housing 20 may be constructed from a material with a relatively low capacity to extract, conduct and radiate heat, to line the surfaces of the housing with insulation material, to use double or triple walls, or to reduce the temperature of exterior surfaces by some other means. Similarly, it may be necessary or desirable to construct the inlet 30 and the outlet 80 so as to keep the exterior surfaces thereof cool, by employing methods as described above for the housing 20.

Referring to FIG. 1, as well as FIGS. 2, 3, 5 and 6, the heat reclamation device 8 preferably includes a fan 160 enclosed within a fan housing 170. The fan 160 and fan housing 170 are fixed to the exterior of the side wall 110. In use, the fan 160 moves ambient air 70, and the fan housing 170 is adapted to increase heat transfer by forcing ambient air 70 to flow over, and be warmed by, the radiation fins 140 so as to improve the efficiency of the device in reclaiming heat. It is to be recognized that alternative means for forcing and directing movement of ambient air 70 may be provided without departing from the principles of this invention.

Referring to FIGS. 1, 2, 3, 4, 5 and 6, the heat reclamation device 8 preferably includes a bypass conduit 180, a gate 190, a pivot rod 200, a crank 210, and a quadrant 220 for selectively directing exhaust either into the baffle 50, 51 or 52 for heat reclamation or away from the baffle 50, 51 or 52 to prevent such extraction. The bypass conduit 180 has a bottom end in communication with the inlet 30 and a top end in communication with the outlet 80. The gate 190 preferably is positioned at the bottom end of the bypass conduit 180 and is adapted to rotate about the pivot rod 200. The crank 210 controls the rotational movement and positioning of the gate 190 and is held in place by seating it in notches 230 in the quadrant 220. The quadrant 220 is permanently attached to the heat reclamation device.

The crank 210 generally has two positions. When the crank 210 is moved to one position 211, the gate 190 rotates to close the communication between the bottom end of the bypass conduit 180 and the inlet 30 such that the exhaust 40 is directed to the baffle 50, 51 or 52 for heat reclamation. When the crank 210 is moved to the other position 212, the gate 190 rotates to open the communication between the bottom end of the bypass conduit 180 and the inlet 30 such that the exhaust 40 is directed to the bypass conduit 180 and therefrom is vented directly to the outlet 80 without flowing through the baffle 50, 51 or 52. In that case, no heat reclamation occurs. In order to prevent unwanted heat transfer to the heat sink 60 when the exhaust 40 is directed through the bypass conduit 180, the bypass conduit 180 preferably is lined with insulation (not shown).

Although the bypass conduit 180, the gate 190, the pivot rod 200, the crank 210 and the quadrant 220 are preferred, it is to be recognized that alternative means for selectively directing exhaust may be provided without departing from the principles of this invention. For example, the gate may be designed to slide rather than rotate such that the pivot rod 200, the crank 210 and the quadrant 220 are not included.

The heat reclamation device preferably includes a condensation drain (not shown) in circumstances where condensation must be drained from the baffle. The condensation drain is positioned a the bottom of the baffle 50, 51 or 52 so as to accumulate the moisture that condenses on the interior surfaces of the baffle 50, 51 or 52. The condensation drain preferably opens for removal of accumulated condensation and closes to seal the baffle 50, 51 or 52.

The heat reclamation device 8 also preferably includes a heat actuated switch 161 disposed within the baffle such that, in operation, the switch responds to the temperature of the exhaust 40 flowing through the baffle to turn the fan 160 on when the temperature within the baffle exceeds a predetermined value and off when the temperature drops below that value.

In constructing the heat reclamation device 8, the housing 20, inlet 30, baffle 50, 51 or 52, outlet 80 and heat sink 60 are combined in a geometry having a generally thin profile so that the device may be installed above and behind the work surface of the cooking appliance 10, and beneath the upper boundary 13 of the work area 11. With that construction and installation, the heat reclamation device is adapted to consume a minimal amount of space while not interfering with the normal use of the cooking appliance 10. To that end, the depth $D_2$ of the baffle of the reclamation device 8 is selected no smaller than depth $D_1$ of the inlet 30, $D_1$ being the depth where the inlet 30 just fits over the exhaust outlet of a given appliance with which the device is to be used. In addition, for a given baffle width $W_1$, the depth $D_2$ preferably is selected no larger than necessary to match substantially the cross-sectional area of the channel of the baffle 50, 51 or 52 disposed adjacent to the inlet 30 to the cross-sectional area of the inlet 30 so as not to restrict the flow of the exhaust 40 therethrough.

Because the product of pressure times volume is proportional to the temperature of gas and because the temperature of the exhaust 40 decreases as it flows through the channel of the baffle, it is preferred to decrease the incremental cross-sectional area of the channel of the baffle from the inlet 30 to the outlet 80 so as to maintain a uniform pressure in the baffle and thereby maintain the velocity of the exhaust 40 through the baffling. That is, although the cross-sectional area of the channel of the baffle 50, 51 or 52 may vary, it is maintained at or above that necessary to maximize heat extraction by the baffle while preventing the exhaust 40 from building up or drafting back into the cooking appliance 10. Preferably, the cross-sectional area should decrease substantially in proportion to the decrease in temperature from the inlet 30 to the outlet 80.

In selecting $D_2$, the widths $W_1$ of the baffle and $W_2$ of the device preferably are maximized for a given lateral clearance, and the height H of the device preferably is maximized for a given vertical clearance, thereby minimizing the depth while maximizing the volume of the baffle and the device. In practice, it is preferred that the width $W_2$ be at least about the same width as the appliance 10, but the width $W_2$ may be increased to consume space if any, disposed toward the back of the appliance 10 between each side of the appliance 10 and the respective walls of the work area 11 in which the appliance 10 is installed. In addition, it is preferred that the height H be substantially equal to the distance between the work surface of the appliance 10 and the roof, hood or other upper boundary 13 above the rear of the appliance 10.

The housing 20 provides an air-tight seal for the baffle 50, 51 or 52 so that the exhaust 40 is contained within the baffle 50, 51 or 52 and is vented out the outlet 80 disposing moisture and dangerous gases into the atmosphere, not into living spaces.

In the alternative embodiment of the heat reclamation device 8 shown in FIG. 6, the venting conduit 130 has dimensions selected so as not to restrict the flow of the exhaust 40 therethrough; and the center baffle 128 is in air-tight communication with the outlet 80 by means of the venting conduit 130 so that the exhaust 40 is contained therein for venting out the outlet 80.

So constructed, the heat reclamation device is simple in design so as to be easy to manufacture and use, economical to manufacture, and inexpensive to purchase and is thermally efficient, easy to install, requires minimal space and is relatively maintenance free.

The terms and expressions which have been employed in the foregoing specification are employed therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A heat reclamation device for reclaiming waste heat from the exhaust outlet of an appliance to warm ambient air, comprising:

(a) enclosed baffle means, having a top, a bottom, a back wall, a device exhaust inlet disposed at the bottom for connection to an exhaust outlet of said appliance, and a device exhaust outlet disposed at the top, for guiding exhaust gas from said exhaust outlet of said appliance to said device exhaust outlet;

(b) guidance means, disposed within said baffle means and extending laterally with respect to said back wall, for guiding said exhaust gas over a circuitous path within said baffle means so as to increase the surface area within said baffle means in contact with said exhaust gas; and (c) fin means, disposed on said back wall outside said baffle means, extending laterally from said back wall and being in thermal communication with said exhaust gas within said baffle means, for transferring heat from said exhaust gas within said baffle means to said fin means and transferring said heat from said fin means to the surrounding air.

2. The heat reclamation device of claim 1, wherein said fin means is in thermal communication with said back wall and with said guidance means.

3. The heat reclamation device of claim 1, wherein said fin means comprises substantially flat, elongate blades having longitudinal axes disposed along said width of said device and positioned in substantially parallel planes spaced at substantially uniform intervals along said height of said device.

4. The heat reclamation device of claim 1, wherein said baffle means comprises a channel having a first end in communication with said exhaust outlet of said appliance, said first end having a cross-sectional area substantially no smaller than the cross-sectional area of said exhaust outlet of said appliance.

5. The heat reclamation device of claim 1, wherein said baffle means comprises a channel having a first end and a second end, said channel extending between said first end and said second end substantially from said device exhaust inlet to said device exhaust outlet, said channel having a cross-sectional area that decreases from said first end to said second end substantially in proportion to the decrease in temperature of said exhaust therealong.

6. The heat reclamation device of claim 1, wherein said baffle means, said guidance means and said fin means are formed as one piece.

7. The heat reclamation device of claim 1, wherein said baffle means has a first side and a second side, and said guidance means defines a channel within said baffle means, said channel having a first end and a second end, and extending back and forth between said first side and said second side of said baffle means, said first end being disposed at the bottom of said baffle means and said second end being disposed at the top of said baffle means.

8. The heat reclamation device of claim 1, wherein said baffle means has a first side and a second side, and said guidance means defines a channel within said baffle means, said channel having a first end and a second end, and extending back and forth between said top and said bottom of said baffle means said first end being disposed at the bottom of said baffle means and said second end being disposed at the top of said baffle means.

9. The heat reclamation device of claim 1, wherein said baffle means has a center and said guidance means defines a channel extending substantially from said device exhaust inlet of said baffle means in a spiral to said center of said baffle means.

10. The heat reclamation of claim 1, further comprising bypass means for selectively directing exhaust either to or away from said baffle means.

11. The heat reclamation device of claim 10, wherein said bypass means comprises a bypass conduit and gating means for selectively gating said exhaust of said appliance to said bypass conduit or to said baffle means, said bypass conduit venting said exhaust from said device exhaust inlet to said device exhaust outlet thereby bypassing said baffle means.

12. The heat reclamation device of claim 11, wherein said gating means comprises a quadrant.

13. The heat reclamation device of claim 25, further comprising air forcing means for forcing ambient air to flow over said fin means.

14. The heat reclamation device of claim 13, wherein said air forcing means comprises a fan, a fan housing and a heat actuated switch associated with said baffle means to turn said fan on when the temperature within said baffle means exceeds a predetermined value.

* * * * *